United States Patent [19]

Waelti

[11] Patent Number: 4,827,673

[45] Date of Patent: May 9, 1989

[54] PROCESS AND DEVICE FOR GRINDING MOULDING BLANKS TO SIZE

[75] Inventor: Werner Waelti, Selzach, Switzerland

[73] Assignee: Tschudin Werkzeugmaschinenfabrik, Grenchen, Switzerland

[21] Appl. No.: 180,112

[22] PCT Filed: Jul. 17, 1987

[86] PCT No.: PCT/CH87/00088

§ 371 Date: Mar. 17, 1988

§ 102(e) Date: Mar. 17, 1988

[87] PCT Pub. No.: WO88/00512

PCT Pub. Date: Jan. 28, 1988

[30] Foreign Application Priority Data

Jul. 21, 1986 [CH] Switzerland ..... 2912/86

[51] Int. Cl.[4] ..... B24B 49/04

[52] U.S. Cl. ..... 51/165.75; 51/289 R; 51/238 GG; 51/103 C

[58] Field of Search ..... 51/289 R, 74 R, 103 R, 51/103 C, 165.75, 165.91, 238 R, 238 S, 238 GG, 105 R, 105 SP

[56] References Cited

U.S. PATENT DOCUMENTS 4,274,230 6/1981 Thalheim ..... 51/165.91

4,294,045 10/1981 Enometo et al. ..... 51/165.91

*Primary Examiner*—Frederick R. Schmidt

*Assistant Examiner*—Maurina Rachuba

*Attorney, Agent, or Firm*—Sherman & Shalloway

[57] ABSTRACT

For grinding to size a preform (18), particularly a cast preform, wherewith one or more cyindrical or conical regions (3, 4) and an end region (10) are to be ground to size between centers without re-chucking, a U-shaped intermediate jig (23) is required, whereby the centering chamber (28) of the tailstock (27) is disposed at a location displaced from the tailstock in the direction toward the headstock (25). The bore of the centering chamber extends completely through the jig member (26), and is configured to provide a steadying and centering member, wherewith a portion of the preform (18) can still pass through said chamber. This portion (4, 10) thereby extends free between the headstock (25) and tailstock (27), where said portion can be ground by a grinding wheel (29) which can be extended along the axis of centers (D) beyond the between-centers region into the region between the centering chamber (28) and the tailstock (27). This arrangement avoids the need to re-chuck the preform (18); the preform can be ground to size in a single chucking between lathe centers.

4 Claims, 3 Drawing Sheets

PROCESS AND DEVICE FOR GRINDING MOULDING BLANKS TO SIZE

The invention relates to a method according to the preamble of claim 1, whereby preforms (particularly, cast preforms) which have been preliminarily ground can be finalground to size; and to device according to claim 2, for carrying out the inventive method.

It is known to produce axially symmetric profiled parts by machining on a lathe, followed by grinding. When such parts are subject to stringent requirements with regard to dimensional accuracy and axial symmetry, ordinarily they are first machined (on a lathe), then possibly hardened, then pre-ground in a centerless grinding operation , and finally ground to size in one or more grinding operations.

In this grinding to size of pre-ground parts, in cases where only one end of the part needs to be ground to size and another region is subject to stringent tolerances with regard to cylindricity or conicity, the grinding must be carried out between lathe-centers (turning centers), whereby two or more grinding operations are performed, between successive pairs of which operations the workpiece is re-chucked on the grinding machine.

This multistep grinding method with rechucking is very labor intensive and time consuming. Cases where the method does not make the attainment of the desired high dimensional accuracy impossible, it makes it difficult. In any event, the method is costly.

The underlying problem of the present invention is to devise a method and device whereby the disadvantages of the customary means of grinding pre-ground parts to size are overcome, such that one can economically fabricate ground profiled parts of high dimensional accuracy and axial symmetry which are ground to size as accurately as possible in a single grinding step while mounted between lathe-centers, even when an end region of the workpiece must be included in the ground areas.

This problem is solved according to the invention by a method as set forth in claim 1, and by a device as set forth in claim 2.

The invention for the first time enables one to grind preforms to size with high dimensional accuracy and axial symmetry, by feasible and economical means, in a single operation while held between lathe-centers. Under the state of the art, such preforms would have to be ground in two or more grinding operations with two or more chuckings of the workpiece on the grinding machine. With the use of the invention, even preforms with a plurality of discontinuities (offsets) can generally be ground to size with a single chucking; and this is beneficial to manufacturing economy and the dimensional accuracy of the products.

Additional advantages and details of the invention will be apparent from the following description and from the associated drawings. In this connection, the invention will be described in more detail with reference to a special precision part which is difficult to produce, namely a nozzle needle for injection nozzles.

Figure 1:
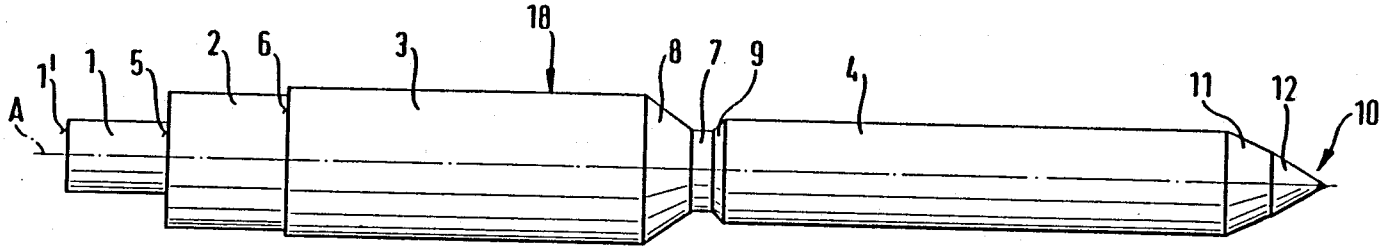
FIG. 1 is an enlarged lateral view of a typical nozzle needle for an injection nozzle.

FIG. 1 shows, in enlarged scale, a nozzle needle for gasoline fuel injection nozzles, of a configuration of such needle which can be ground to size while being held between lathe-centers, in a single grinding operation with the use of the inventive method and device. It is assumed that the preform as received has at least the precision of a centerless-ground part, or that the workpiece has been ground, i.e., pre-ground from a round steel rod in the manner described below. The enormous improvement over the state of the art afforded by the invention in grinding preforms accurately to size in serial production is apparent if one considers that the tolerance in grinding such a part having length c. 50 mm and mean diameter c. 4.8 mm is 0.001 mm, and that the maximum tolerable out-of-round in the apex region is 0.001 mm; and further that the ground part meeting these requirements can be fabricated fully automatically, with a single operation of grinding to size, while being held between lathe-centers, advantageously in combination with the hereinbelow described means of grinding the preform out of a rod. It should be noted that the nozzle needle illustrated has an end face 1' which must be ground at a precise right angle to the longitudinal axis A of the needle, a thrust bearing surface 5, and a release transition 6, in addition to cylindrical regions (namely a nozzle pin 1, a release region 2, a guiding surface 3, and a needle shaft 4). As is seen, a groove 7 separates the needle shaft 4 from the guiding surface 3. Groove 7 is bounded by two conical regions which are at specific, different valued angles, which regions are namely a support surface 8 for engaging a steadying and centering member on the grinding machine, and a transition surface 9. The apex region 10 of the nozzle needle has two conical segments of different cone angle, namely a seating segment 11 and a free segment 12, which must have highly accurate angles and lengths in order for the injection valve to function properly. The cylindrical guiding surface 3 of the needle must have perfect cylindricity and must be ground to match the internal bore of the needle housing (not shown) which accommodates the needle, so that the needle will be guided longitudinally without transverse play.

From the preceding, one skilled in the art will appreciate that the representative preform selected to illustrate the invention is one which is extremely difficult to fabricate with conventional methods and devices, and would be very costly to produce in serial production by means of turning (on a lathe) and stepwise grindng of the various diameters and angles. This particular challenging part (the said preform) is well suited to demonstrate the advantages and superior range of applicability of the invention over the customary means of fabricating such parts.

In evaluating the advantages afforded by the invention, one should start with the fact that known methods of fabricating the subject nozzle needle involve turning an intermediate piece from an unhardened steel rod, on a lathe, then hardening this intermediate piece, pre-grinding it in a centerless grinding operation, and employing separate grinding operations with separate chuckings of the preform 18 to final-grind first the guiding surface 3, and then the conical seating segment 11 and the conical free segment 12 of the apex region 10. With this method it is practically impossible to provide the required axial parallellness while meeting the out-of-round tolerance, because the preform is clamped differently when grinding the cylindrical guiding surface 3, and for grinding the two conical segments (11, 12) of the apex region 10 the preform must be held in a chuck.

Figure 2:
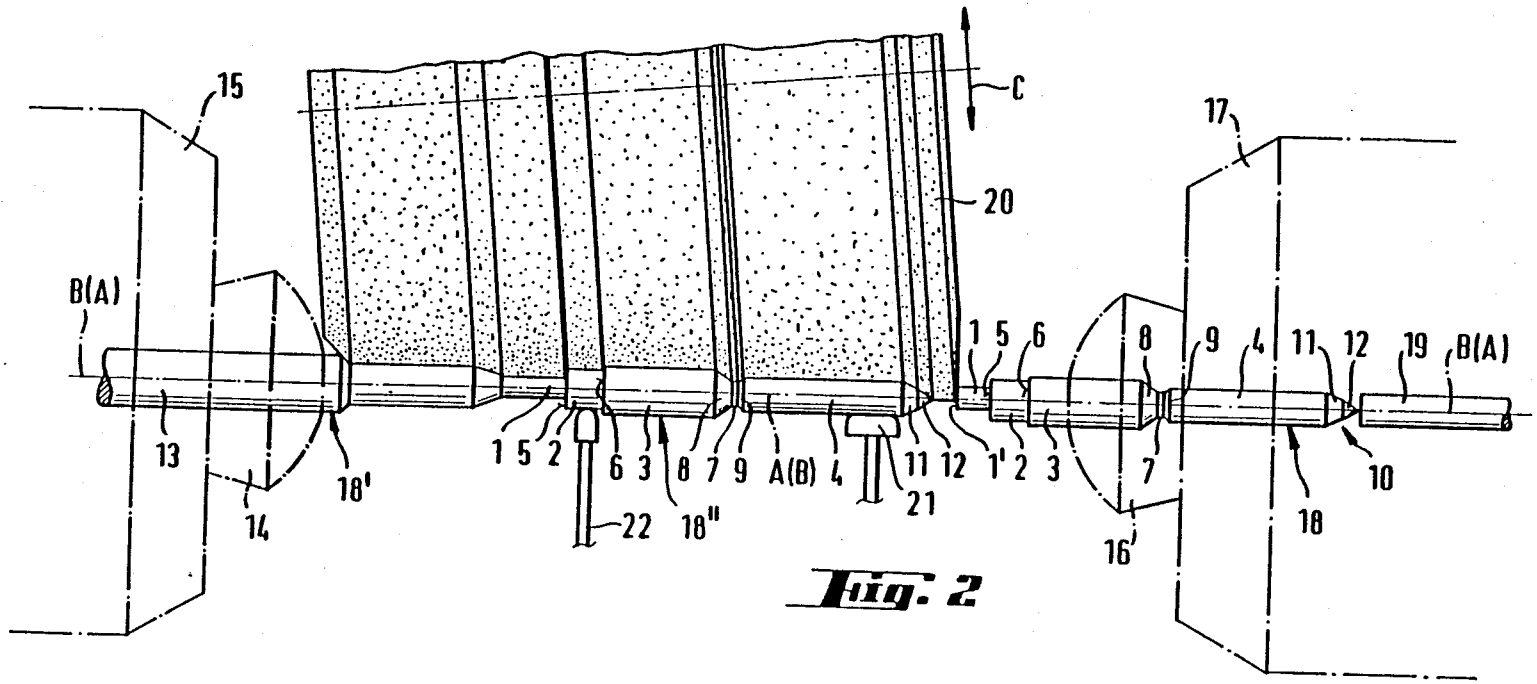
FIG. 2 is a schematic plan view of the arrangement of a device on which a first step is carried out in the fabrication of the ground part, namely pre-grinding the workpiece and cutting it off from the rod.

Instead of using lathing and centerless grinding to fabricate the preforms used as starting workpieces in the inventive grinding to size, one may advantageously employ a grinding technique which will be presently described with reference to FIG. 2. FIG. 2 shows a round rod 13, advantageously comprised of unhardened or hardened steel, which is extended through a first collet 14 of a headstock 15 (shown only schematically, with dot-dashed lines). The preforms 18 are to be formed in a line from this rod. Opposite collet 14 on the same axis B is a second collet 16 which is disposed in a synchronous tailstock 17. The rod 13 (or a preform 18 still connected to the rod 13) is inserted in collet 16 up to a detent 19 which can be adjustably fixed in place. Advantageously, the headstock 15 and the synchronous tailstock 17 are components of a numerically controlled grinding machine, so that all operations and movements can be controlled automatically.

Also shown in FIG. 2 is a profiled grinding wheel 20 and a steadying piece 21. The axis B is not perpendicular to the direction of advance (double arrow C) of the profiled grinding wheel 20 but is inclined thereto. An inclination of c. 10° has proven advantageous. This enables correct grinding of surfaces which are to be perpendicular to the longitudinal axis A of the preform, in a single grinding operation, so that such surfaces are in fact perpendicular to axis A; these surfaces are namely the end face 1', the thrust bearing surface 5, and the release transition 6. It is obvious how the perimeter of the profiled grinding wheel 20 can itself be ground to shape in situ without disengaging wheel 20 from the workpiece, in known fashion and in dependence on the inclination of the arrow and the profile which is to be conferred on the preform 18, at regular time intervals and directly under control of the NC system, with the aid of, e.g., a diamond-surfaced roll. The resulting attrition of material from the grinding wheel is taken into account in known fashion in the automatic calculation of the advance of the profiled grinding wheel. Advantageously, the profiled grinding wheel 20 is configured such that it can perform the following grinding tasks simultaneously in a single working step: pregrinding of part of a first preform 18', finish-grinding of at least part (or all) of preform 18'', and severance, from preform 18'', of the previously ground preform 18 which has been completed (except for facing of its end face 1') and is now partially disposed in the second collet 16. In order to prevent deflection of the currently being ground preform 18'' away from the axis B, and thus away from the longitudinal axis A of the preform, a steadying piece 21 is appropriately held.

As soon as pre-grinding of the preform 18'' which is being ground has been completed, advantageously the second collet 16 (in the synchronous tailstock 17) is opened and is retracted such that preform 18 which still partially extends into collet 16 and which has now been severed from the rod 13 can be ejected from collet 16 by the detent 19, after which the rod 13 is advanced until the preform 18'' (still connected to rod 13) has been moved into the former position of turned part 18 in the second collet 16. Then the above-described grinding operation is repeated, possibly after a preliminary retraction of the profiled grinding wheel 20. Thereby a part of a third preform 18' is preground, and part (or all) of preform 18'' is finish-ground (including severance from rod 13). It may be advisable to check a critical local diameter during this working step, with the aid of a diameter-measuring head 22, while grinding is taking place, to enable use of this local diameter measurement for control of the advance of the profiled grinding wheel.

Figure 3:
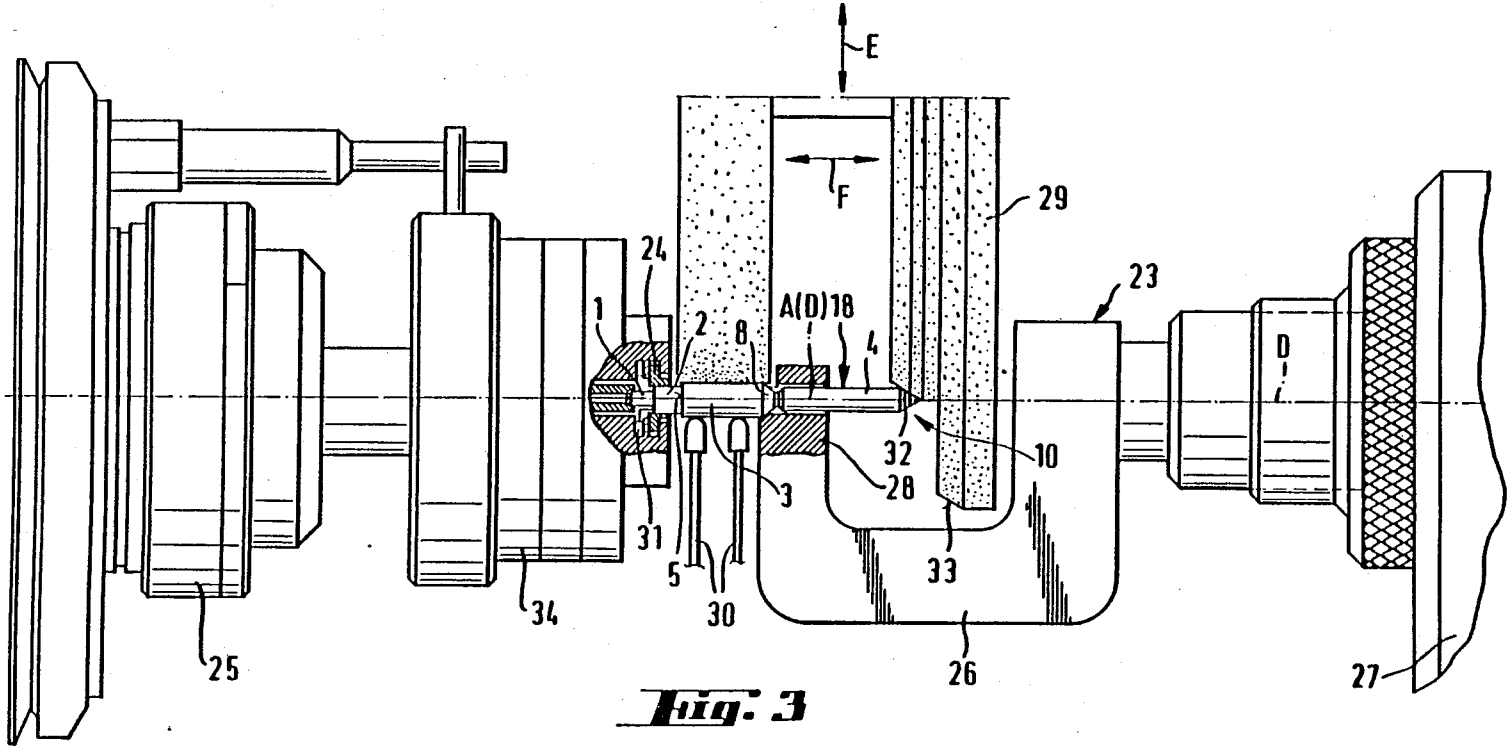
FIG. 3 is a partial cutaway plan view of an inventive device for grinding to size the pre-ground part according to the invention, with a single chucking between lathe-centers and with a single grinding step.
Figure 4:
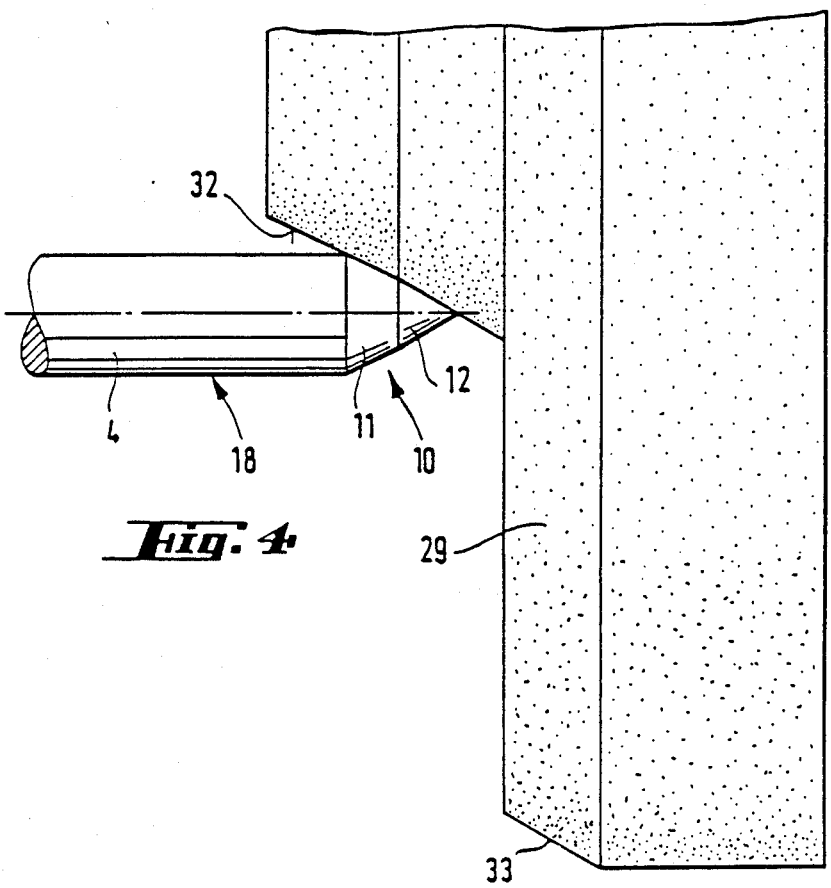
FIG. 4 is a detail view, from the top, of the grinding of the apex region of the needle.
Figure 5:
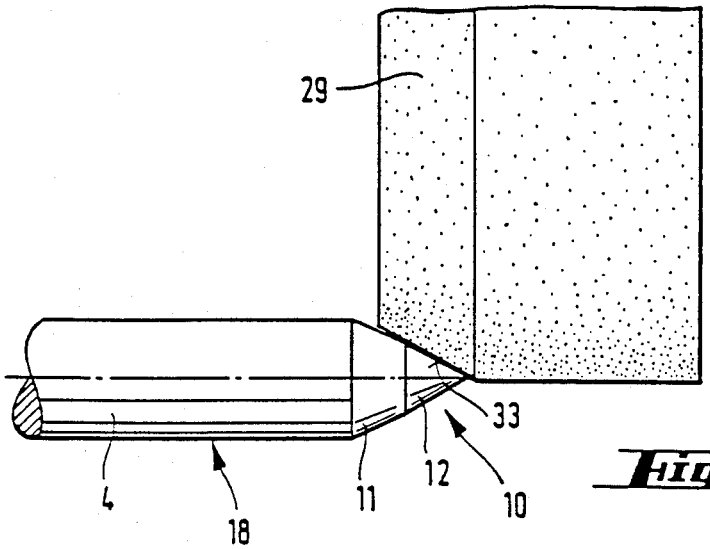
FIG. 5 is another detail view, from the top, of the grinding of the apex region of the needle.

The preforms 18 fabricated according to the described grinding operation, if ground from hardened rods 13, are now finished products. They have at least the dimensional accuracy and surface quality of centerless-ground parts. Therefore they can be sent directly to the operation of grinding to size, without further preparatory treatment. Even if the preforms 18 are ground from unhardened rods 13, their dimensions are more accurate than if they had been fabricated by turning on a lathe. In a subsequent carefully managed hardening operation, they will suffer practically no distortion. Accordingly, if they are provided with slightly oversized dimensions, and are to be ground to size only in the final grinding, they may be sent directly to the operation of grinding to size, without further preparatory treatment. In any event, this technique of fabricating the preforms obviates a centerless grinding operation prior to the grinding to size in the inventive device of FIG. 3. The grinding to size of the preforms 18 is illustrated in FIGS. 3 to 5, with FIGS. 4 and 5 illustrating only details of individual working steps. FIG. 3 shows the way the preforms are held, and shows a fine-grinding profiled grinding wheel 29 by which the preform 18 is final ground to produce the high precision nozzle needle which is ground to mate with the inner bore of the nozzle needle valve housing (not shown). As mentioned, the inventive method and device enable the finish-grinding of the nozzle needle to be accomplished with a single chucking of the preform 18 between lathe-centers. The preform 18 illustrated only requires finish grinding on its large diameter (the cylindrical guide surface 3) and on the seating segment 11 and free segment 12, of the apex region 10, the purpose in the case of surface 3 being to produce the required cylindricity and the prescribed play in the inner bore of the valve housing, by means of mating-grinding, and the purpose in the case of the apex region 10 being to meet out-of-round tolerances in relation to the longitudinal axis A of the nozzle needle. It is seen that it is not possible to perform the grinding of the nozzle needle between collet means which support the two ends, as is customary. Rather, according to the invention, a special centering jig 23 (FIG. 3) is employed.

It is seen from FIG. 3 that the rear end (the pressure pin 1) of the preform 18 is inserted in a so-called 6-degree carrier 24 which comprises part of a transverse-force-free workpiece drive 34, such that the part is driven at the edge region disposed between the pressure pin 1 and the release region 2 for the thrust bearing surface 5 of the nozzle needle, said driving being by the carrier 24 which in turn is rotationally driven. Advantageously, the carrier 24 is retractable in the direction of the headstock 25, in order to be able to insert the preform 18 into the centering jig 23 from the direction of the headstock 25 before the carrier 24 is engaged with the preform 18. The centering jig 23 is comprised essentially of a U-shaped supporting member 26 which is connected to the tailstock of the grinding machine (which machine is advantageously numerically controlled), similarly to collet, and itself has a centering chamber 28 passing through it and disposed precisely on the "axis of centers" D joining the headstock and tailstock centers, whereby the preform 18 can pass through said chamber and be guided and centered at a location on said preform which does not require grinding during the final grinding step of the preform 18, and which location is configured as a support region for engaging the centering jig.

In the nozzle needle illustrated, the support surface 8 in the groove 7 is engaged by the configuration in the centering chamber 28, such that only the cylindrical guide surface 3 (which, as mentioned, must be ground to mate with a corresponding valve bore) will be ground between the lathe-centers. The needle shaft 4, and the apex region which adjoins it and which has the two conical segments (conical seating segment 11 and conical free segment 12) which must be final-ground, extend out of the centering chamber 28 and toward the tailstock 27, such that the needle shaft 4 and adjoining conical segments 11 and 12 can be ground while in a self-supporting condition, by the fine-grinding profiled grinding wheel 29 which extends into the interior region of the centering jig 23. The inventive jig 23 enables final grinding-to-size of a plurality of cylindrical regions of the preform 18 as well as an end region, with only a single chucking operation (i.e., without having to rechuck the workpiece). The cylindrical region of interest in the illustrated nozzle needle is that of the guide region 3 which must be ground to mate with a corresponding valve bore. This final-grinding can be accomplished either with a separate fine-grinding profiled grinding wheel or with a part of a combined fine-grinding profiled grinding wheel 29 as illustrated in FIG. 3. The end region requiring grinding is the apex region 10 of the preform 18. A dual measuring head device 30 may be employed in known fashion to measure and control the cylindricity of the guide region 3 and the precise diameter thereof. In this connection, the headstock may be provided with a device for cylindrical grinding of workpieces, according to Swiss Pat. No. 623,261. By the use of a commercially widely available longitudinal position measuring device 31 (shown only schematically) to measure the longitudinal position of the preform 18 in the carrier 24, and/or to measure the precise position of the needle thrust bearing surface 5 on the axis of centers D, the fine-grinding profiled grinding wheel 29 can be adjusted laterally (double arrow F) in a direction normal to its usual direction of advance (double arrow E), such that the part of the fine-grinding profiled grinding wheel 29, or the separate grinding wheel, which part or which wheel serves to final-grind the support segment 11 and free segment 12 of the apex region 10, will ensure (e.g., adjust) the proper length of the nozzle needle as well as final-grind these conical segments. If necessary on grounds of strength, a steadying piece may be employed in this grinding operation to support the unsupported end region of the preform 18 and thus avoid undesired deformation of this region. Advantageously, for preforms (particularly, cast preforms) such as the nozzle needle illustrated, two grinding wheels may be combined into a single grinding wheel assembly, particularly a single-unit fine-grinding profiled grinding wheel 29. The grinding wheel(s) may also be regularly and automatically ground true, as is usually a feature of NC grinding machines, to provide optimal precision and surface quality of the final-ground nozzle needle.

For final grinding of the conical seating segment 11 and conical free segment 12 of the apex region 10, the finegrinding profiled grinding wheel 29 may be supplied with two different applicable profiles 32 and 33, wherewith, e.g., the first profile 32 (FIG. 4) is employed to final-grind the seating segment 11 and pre-grind the free segment 12, at the same time that the cylindrical guide region 3 is being final-ground to mate with the corresponding valve bore; then the fine-grinding profiled grinding wheel 29 is withdrawn and reapplied to final-grind the free segment 12 by means of the second profile 33 (FIG. 5).

One skilled in the art will appreciate that the inventive method and device enable the workpiece to be ground to size in two working steps with only a single chucking between centers, whereas grinding to size according to the state of the art would require multiple chuckings. Obviously, other preforms than nozzle needles for fuel injection pumps can be fabricated with the inventive method and device, economically and with a reduced number of chuckings in comparison to customary fabricating techniques. The profiled grinding wheels (20, 29) and the application of the centering jig 23 for the preform 18 need merely to be adapted to the specific conditions. There is no inventiveness required in this adaptation.

Also obvious is that in the pre-grinding of some preforms, in the severing from the rod 13 by grinding, it may be necessary to pre-grind only specific regions of the preform, with other regions being left unground. Further, in the final grinding of the preform 18, more than the above-described three segments may be final-ground. If necessary or desirable, the final grinding can be accomplished in two distinct operations.

If an automatic rod feed device for feeding rods in succession and an automatic preform chucking device are employed, the fabrication of the ground parts can be completely automated, with the application of the invention to the described general technique of grinding preforms 18 from a rod 13. No manual readjustment of the tools is required, because the profiled grinding wheels 20 and 29 can be ground true by diamond-surfaced rolls directly on the NC grinding machine, and are automatically realigned.

If coiled material is used instead of straight rods as the starting stock for the manufacture of the preforms, which is a possibility due to the much lower rpm which is required for a ground piece in comparison to a lathe-turned piece, fully automatic manufacturing of parts can be set up to continue autonomously for days, without human intervention. This is not an achievable option with cutting machine (lathe) operations, because such operations invariably require a subsequent grinding stage to sharpen the cutting tool, which grinding is carried out outside the machine, followed by hand readjustment.

Individual steps of the inventive method, and components of the inventive device, may be modified as required by the characteristics of the parts being fabricated.

I claim:

1. In a method of pre-gringing preforms (18) to size in a grinding machine having a head stock (25) having a center, a carrier (24), and a tailstock (27) having a center, an imaginary line joining said headstock center and said tailstock center defining an axis of centers (D) in said grinding machine, said preforms each having a first end, a second end and a longitudinal axis (A) and being symmetric with respect to said longitudinal axis (A), each said preform (18) which is to be ground to size being rotated around said longitudinal axis by means of said carrier at said first end on said headstock side, wherewith on the tailstock side said preform is mounted in a centering chamber (28), with a double measuring head (30) being provided to ensure the alignment of said longitudinal axis (A) of said preform (18) on said axis of centers (D), and wherewith one or more grinding wheels (29) grind said preform (18) to size in a plurality of regions of said preform, the improvement comprising: supporting said preform on the tailstock side in said centering chamber (28) which is in the form of a jig with a steadying and centering member, through which chamber (28) a part of said preform (18) can extend, and said steadying and centering member supports said preform (18) at a support surface (8) of the preform such that even an end region (10) of a portion (4,10) of the preform (18) which portion extends beyond the centering chamber 28 can be ground in the grinding machine without re-chucking the preform (18).

2. In a device for carrying out the method according to claim 5 on a grinding machine comprising a headstock (25) having a center, a carrier (24) a tailstock (27) having a center and a centering chamber (28), an imaginary line joining said headstock center and said tailstock center defining as axis of centers (D), and further comprised of a double measuring head (30) for control of cylindricity such that said carrier (24) and said centering chamber (28) are disposed on said axis of centers (D), the improvement comprising: said centering chamber (28) being disposed in a U-shaped centering jig (23), said centering chamber (28 being displaced form said tailstock (27) at a distance toward said headstock (25) and configured as a supporting member such that a portion (4) of said preform (18) extends through said centering chamber, and said preform (18) is supported in said centering chamber on a support surface (8) which is part of the configuration of said preform (18).

3. The device according to claim 2, wherein said carrier (24) is a part of a transverse-force-free workpiece drive (34), and, in cooperation with said double measuring head (30), enables alignment of a longitudinal axis (A) of said preform (18) with said axis of centers (d) of said grinding machine; and wherein an end region (10) of said perform (18), which end region (10) extends free between said centering chamber (28) and said tailstock (27), can be ground by a grinding wheel (29) which extends along said axis of centers (D).

4. The device according to claim 2, wherein said carrier (24) is retractable in a direction toward said headstock (25) to enable insertion of said preform (18) into said centering chamber (28).

* * * * *

UNITED STATES PATENT AND TRADEMARK OFFICE

CERTIFICATE OF CORRECTION

PATENT NO. : 4,827,673

DATED : May 9, 1989

INVENTOR(S) : WERNER WAELTI

It is certified that error appears in the above-identified patent and that said Letters Patent is hereby corrected as shown below:

IN THE CLAIMS

Column 7, claim 1, line 16, after "preform", insert --(18)--.

Column 7, claim 2, line 27, delete "claim 5", insert --claim 1--.

Column 8, claim 2, line 2, delete "as", insert --an--;

line 8, delete "form", insert --from--;

Column 8, claim 3, line 19, delete "(d)", insert --(D)--.

Signed and Sealed this

Third Day of October, 1989

*Attest:*

*Attesting Officer*

DONALD J. QUIGG

*Commissioner of Patents and Trademarks*